United States Patent [19]

Woodward et al.

[11] 4,300,261

[45] Nov. 17, 1981

[54] VACUUM CLEANING APPARATUS WITH COMPRESSED AIR MEANS

[75] Inventors: James C. Woodward, Elizabethtown; Marion D. Holland, Cox's Creek, both of Ky.

[73] Assignee: Robert E. Robbins, Elizabethtown, Ky. ; a part interest

[21] Appl. No.: 178,456

[22] Filed: Aug. 15, 1980

[51] Int. Cl.[3] ..... A47L 5/14

[52] U.S. Cl. ..... 15/345; 15/364; 15/397; 15/402

[58] Field of Search ..... 15/345, 346, 383, 384, 15/388, 397, 402, 415 R, 416, 364

[56] References Cited

U.S. PATENT DOCUMENTS

| | | | |
|---|---|---|---|
| 2,003,215 | 5/1935 | Nadig | 15/346 X |
| 2,524,117 | 10/1950 | Storm | 15/346 X |
| 3,268,942 | 8/1966 | Rossman | 15/346 |
| 3,694,848 | 10/1972 | Alcala | 15/346 |

FOREIGN PATENT DOCUMENTS

| | | | |
|---|---|---|---|
| 167076 | 2/1956 | Australia | 15/345 |
| 977910 | 11/1975 | Canada | 15/346 |

*Primary Examiner*—Chris K. Moore

*Attorney, Agent, or Firm*—Richard L. Caslin

[57] ABSTRACT

A vacuum cleaning apparatus using a hood forming a travelling vacuum chamber with an optimum combination of jet stream means and suction nozzle means. The jet stream means includes a plurality of orifices that are generally directed toward the intake of a suction nozzle means so as to cause the soil on the surface to be cleaned to become airborne before being acted upon by the suction nozzle means. A combined motor and air compressor is mounted in the hood means for furnishing compressed air to the jet stream means. The motor may also drive a rotating brush which may be interposed between the jet stream means and the suction nozzle means.

6 Claims, 4 Drawing Figures

VACUUM CLEANING APPARATUS WITH COMPRESSED AIR MEANS

BACKGROUND OF THE INVENTION

1. Field of the Invention his invention relates to vacuum cleaners for household or industrial use for removing foreign matter, dust and debris from floor or carpet surfaces, and particularly those cleaners which provide jet air means for dislodging or agitating the soil and conveying it toward the intake of a suction nozzle means.

2. Description of the Prior Art

An early patent in this art is Farmsworth U.S. Pat. No. 1,281,925 which describes a vacuum cleaner with an inlet opening and a suction-creating, motor/blower wheel or fan that conveys the soil-laden air from the floor or carpet to a porous cleaner bag or filter bag. A second porous cleaner bag or filter bag surrounds the first bag, and part of the air in the second bag is returned to the vicinity of the inlet opening where a blast of air is directed down into the inlet opening to dislodge or agitate the soil on the floor or in the carpet. Thus a partial air recirculating system is provided.

The Hornschuch et al U.S. Pat. No. 3,161,900 describes a vacuum cleaning head for use with mining apparatus around mine shafts and drilling sites. The head is equipped with a high pressure air blast which is operable to impart a velocity to objects heavier than dust so that they may be collected by an integral vacuum device.

The Lake et al U.S. Pat. No. 3,328,827 describes a hand-held, air-operated vacuum cleaner for use around gasoline stations that are equipped with high pressure air hoses for use in inflating automobile tires. Such a high pressure air hose is connected to this Lake vacuum cleaner, and the air pressure drives an air turbine that in turn drives a suction fan. The air turbine and the suction fan are both mounted on a common shaft. This vacuum cleaner has a suction head having outwardly disposed forced air discharge ports and a central suction passage.

The Hilbig U.S. Pat. No. 3,678,534 describes a vacuum system for cleaning some surfaces having insoluble dirt particles or coatings firmly attached thereto or embedded therein. One such surface is an acoustical panel having a honeycomb core covered on one side with a thin, imperforate facing sheet and on the other side by a similar facing sheet having a multiplicity of small perforations. The vacuum cleaner head has a high pressure air line with jets of air moving at supersonic speeds. The jet streams dislodge stubborn dirt particles for removal by a vacuum line communicating with the cleaner head.

The Mac Farland U.S. Pat. No. 3,825,927 describes a shag rug rake attachment for mounting on the cleaning nozzle of a vacuum cleaner for combing deep pile shag rugs.

The Haldeman U.S. Pat. No. 3,963,515 describes a conventional vacuum cleaner suction nozzle typically used for cleaning streets or carpets with a plurality of vortex generating air nozzles supported from the nozzle and directed downward ahead of the suction nozzle.

The Rose et al U.S. Pat. No. 4,037,290 describes an institutional or commercial vacuum cleaner having a downwardly facing hood to form a travelling chamber. An air jet nozzle is positioned within the hood, and the nozzle is moved in a circular horizontal orbit by a variable speed motor. A pump is attached to the hood to maintain a vacuum therein.

OBJECTS OF THE PRESENT INVENTION

A principal object of the present invention is to provide a vacuum cleaning machine with a vacuum hood, travelling vacuum chamber or power nozzle having an optimum combination of motor driven brush in combination with jet stream means on one side and suction nozzle means on the opposite side of the brush wherein compressor means is associated with the motor drive of the brush for supplying compressed air to the jet stream means.

A further object of the present invention is to provide a vacuum cleaner machine having a power nozzle with a rotating brush or roller that is motor driven where the same motor drives an air compressor that supplies jet stream means positioned on the side of the brush or roller that is opposite the suction nozzle means.

A further object of the present invention is to provide a vacuum cleaner machine of the class described wherein the jet stream means are associated with a plurality of flexible tubes which are vertically arranged along one side of the rotating brush or roller.

A further object of the present invention is to provide a vacuum cleaning apparatus with a vacuum hood or travelling vacuum chamber having a combined motor and air compressor means in conjunction with jet stream means so as to augment the suction of a suction nozzle means for improved efficiency of cleaning.

A further object of the present invention is to provide a vacuum cleaning apparatus wherein the combined motor and air compressor means is positioned above the suction nozzle means.

A further object of the present invention is to provide a vacuum cleaning apparatus of the class described wherein the electric motor may also drive an elongated rotating brush that may be positioned between the jet stream means and the suction nozzle means whereby the motor has double utility.

SUMMARY OF THE INVENTION

The present invention provides a vacuum cleaning apparatus having a vacuum hood that is furnished with motor means within the hood means for driving an air compressor means that is associated therewith. Jet stream means is positioned transversely across the hood means adjacent the front side of the hood means and includes a plurality of generally vertical flexible tubes, each having an orifice directed at a flat angle toward the back portion of the hood means. Suction nozzle means are mounted within the hood means for receiving the blast of compressed air from the jet stream means and the soil that is borne thereby.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENTS

Figure 1:
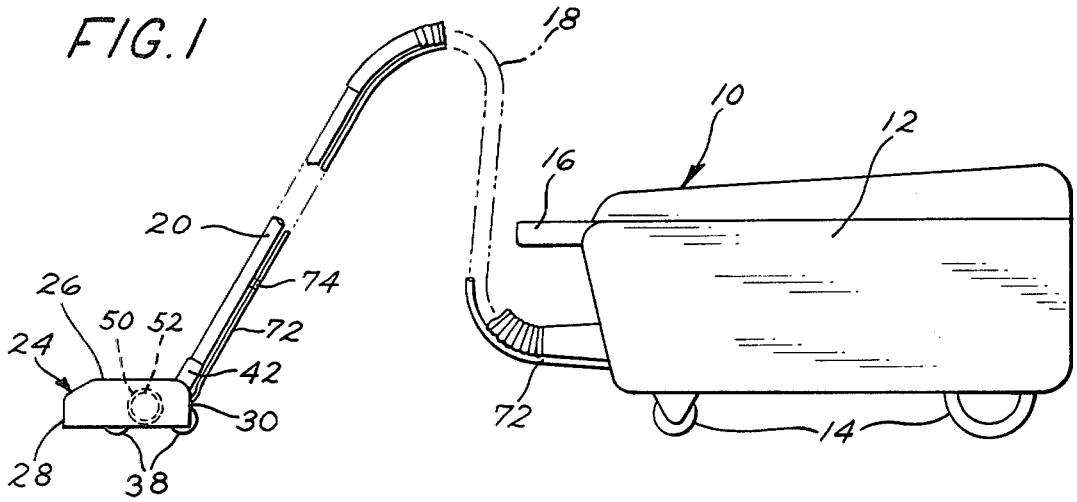
FIG. 1 is a side elevational view of a canister-type vacuum cleaning machine having a floor attachment or hood embodying the present invention.

Turning now to a consideration of the drawings and, in particular, to the side elevational view of FIG. 1, there is shown a canister-type vacuum cleaning machine 10 having a floor mounted canister 12 which embodies the usual vacuum motor/blower unit, a renewable filter bag, an electric power cord reel, and manually setable control means for operating the machine. These standard vacuum cleaner elements of a canister-type machine are not illustrated, as they do not form part of the present invention. What is shown are the support wheels 14, and a front handle 16 for ease in carrying the canister from one place to another. Removably attached to the front of the canister is a flexible, vacuum hose 18 of about 8 feet in length. This hose is adapted to be joined with a slip fit to a metal wand 20, which in turn is fitted into a floor attachment or hood 24. It is within this hood 24 that the present invention is located.

Figure 2:
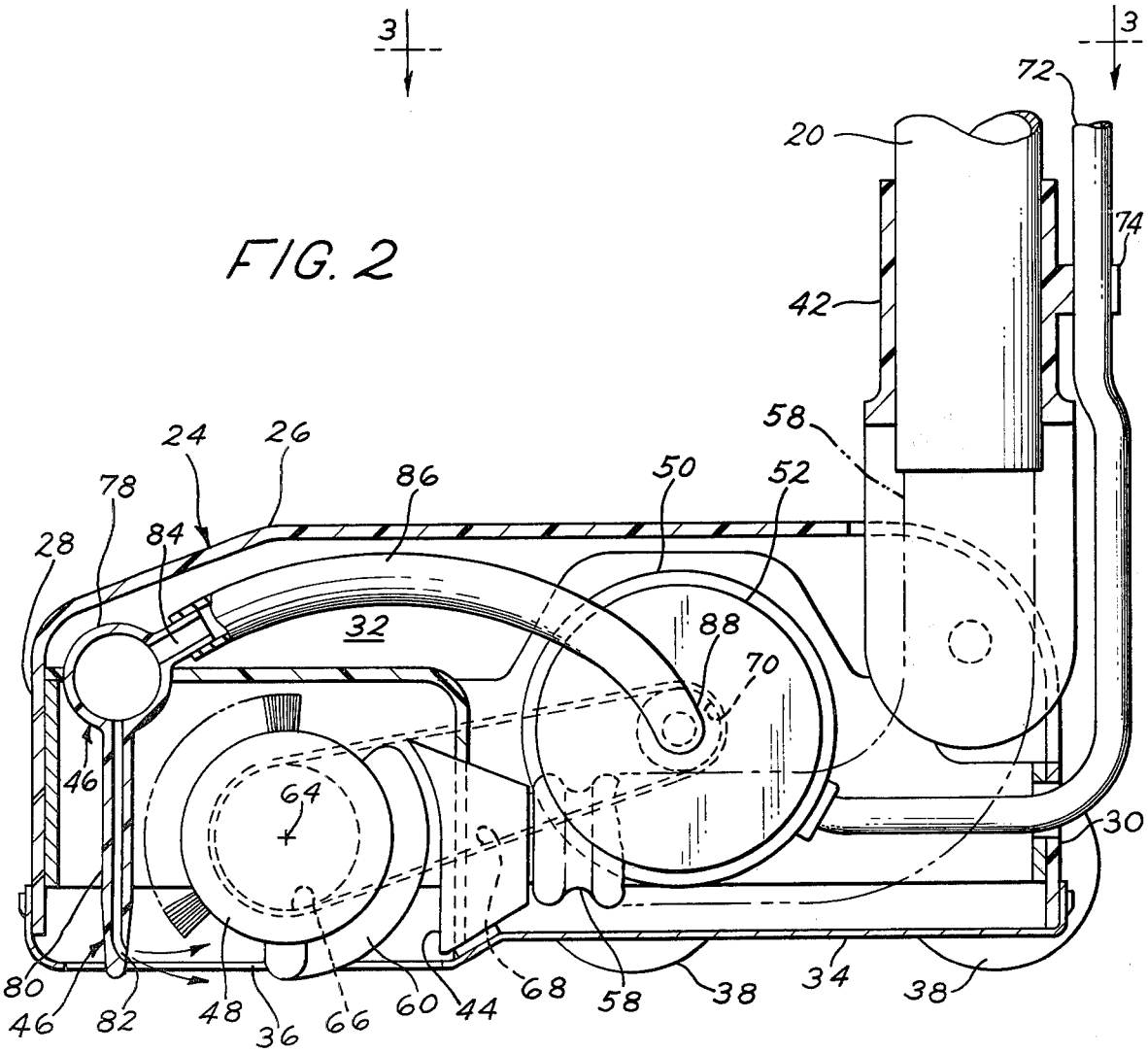
FIG. 2 is a cross-sectional side elevational view on an enlarged scale of the floor attachment or hood of FIG. 1.

FIG. 2 shows the hood 24 in a cross-sectional side elevational view that is taken generally through the center of the hood. The hood 24 is a hollow housing of molded plastic or metal that has a top wall 26, a vertical front wall 28, a vertical rear wall 30, opposite side walls 32, and a generally closed bottom wall 34 at the rear of the hood and an opening 36 toward the front of the hood. The hood 24 is furnished with a plurality of support wheels 38 for ease in gliding the hood over the floor or carpet surface that is to be cleaned. Certain of these support wheels may be vertically adjustable to adapt the hood to various types of shag or sculptured carpets, or other irregular floor surfaces.

The rear portion of the hood 24 is furnished with a pivoted hollow coupler 42 for receiving the lower end of the metal wand 20 therein, as is conventional in this art. Thus, the wand 20 is capable of pivotal movement between a generally vertical position, as seen in FIG. 2, to a generally horizontal position behind the hood 24.

The hood 24 supports five main elements; namely, a suction nozzle means 44 near the center of the hood, a jet stream means 46 adjacent the front, and a motor driven brush 48 interposed between the suction nozzle means 44 and the jet stream means 46, and an electric motor 50 positioned above the suction nozzle means for driving the brush 48 as well as for driving a miniature air compressor 52 that is coupled to an extension 54 of the motor shaft. Suitable mounting means would be provided for both the motor 50 and the compressor 52 to prevent them from turning within the hood 24. Notice that a short length of flexible hose 58 is provided to connect the suction nozzle means 44 with the pivoted hollow coupler 42 and wand 20, as is well shown in both FIGS. 2 and 3. The shaft extension 54 is able to extend over this flexible hose 58 so that neither the motor 50 or the compressor 52 interfere with the flexing of the hose 58.

Figure 3:
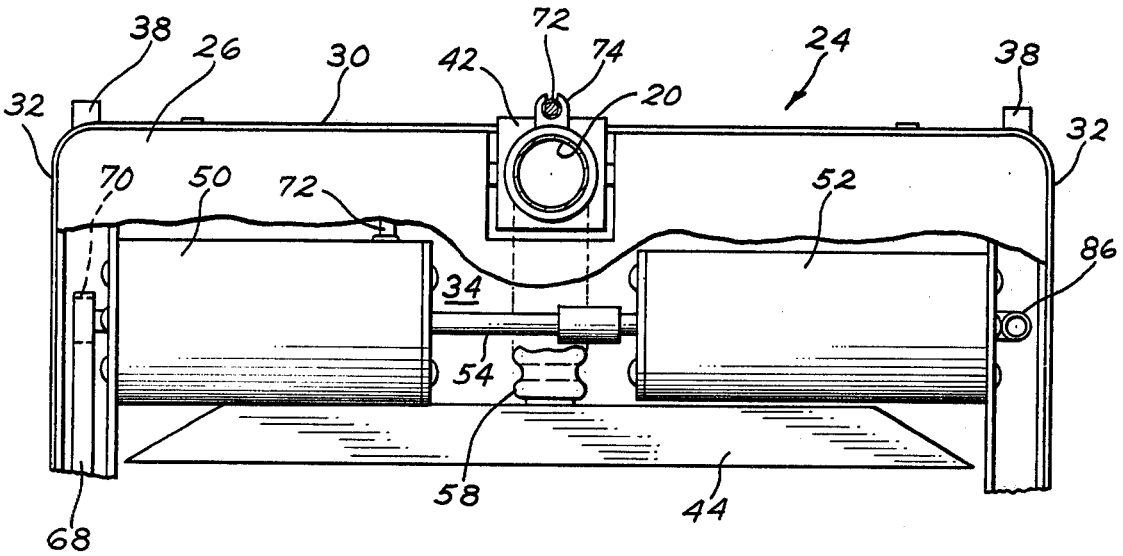
FIG. 3 is a fragmentary cross-sectional plan view of the floor attachment or hood of FIG. 2 showing the nature of the electric motor for driving the brush means where the motor also drives a miniature air compressor.
Figure 4:
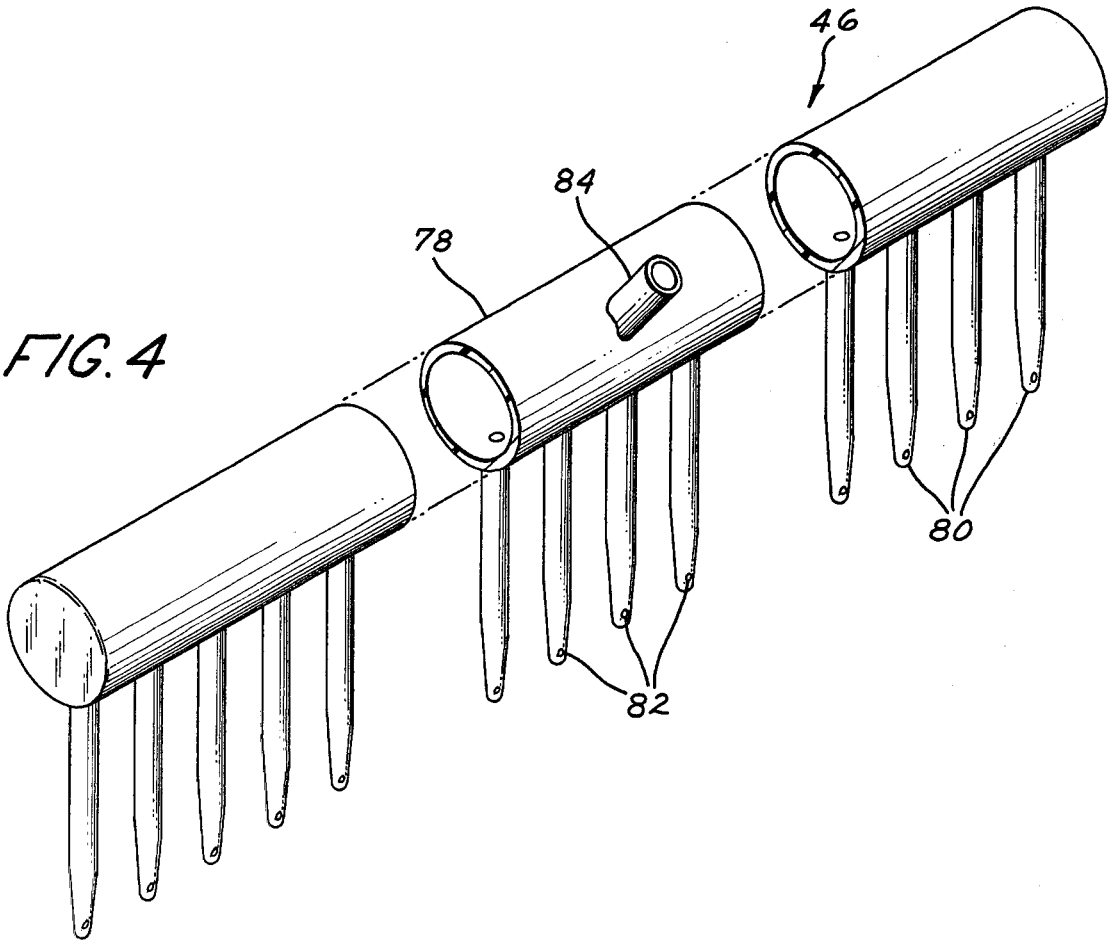
FIG. 4 is an enlarged perspective view, partly broken away, of the jet stream means that is positioned across the hood means and comprises a tubular header having a plurality of vertical flexible tubes, each tube having an orifice that is adapted to be directed at a flat angle toward the working area of the brush means.

The brush or roller 48 may be of standard design as is used today in power nozzles of canister-type vacuum cleaners or as is used in upright vacuum cleaners. The outer surface of the brush 48 is provided with a series of alternate beater bar 60 of spiral like configuration and a diametrically opposite series of bristles 62 for agitating the soil in the carpet or on the floor surface that is to be cleaned. Support bearings (not shown) are present at each end of the brush 48 for supporting the brush to turn about a generally horizontal axis at 64. One end of the brush 48 is extended to include a pulley 66 for receiving an endless belt 68 that is also looped around a second pulley 70 that is mounted on the shaft of the motor as is best seen in FIG. 3. Notice in FIG. 2 an electric power cord 72 for supplying electrical energy for the electric motor 50. This power cord extends out to the back wall 30 of the hood 24 and then generally parallels the wand 20 and the flexible hose 18 until it extends into the canister 12 of the vacuum cleaner 10. Suitable clips 74 are provided on the wand 20 and hose 18 for holding the power cord in a general parallel relationship with the wand and hose.

Positioned just in front of the rotating brush 48 is the jet stream means 46 which comprises a tubular header 78 which extends from one side wall 32 to the other, and it is provided with a plurality of vertical flexible tubes 80 which communicate with the header and are each provided with a small orifice 82 near the bottom tip thereof which is inclined at an angle toward the working area of the rotating brush 48 which happens to lie beneath the horizontal pivotal axis 64 of the brush. The header 78 is furnished with a nipple 84 for receiving a small tube or conduit 86 which is connected to the discharge end 88 of the compressor 52. Thus, there is a short distance between the compressor 52 and the plurality of jet orifices 82 so as to restrict the pressure drop of the compressed air that is furnished by the compressor to the jet stream means.

It should be understood that while the jet stream means 46 has been shown with a plurality of flexible tubes or tines of a rake or comb, the header 78 could be lowered near the open wall 36 of the hood and the orifices 82 could be formed in the header 78, thereby eliminating the flexible tubes 80. One advantage for employing the vertical tubes 80 is that they serve as the tines of a comb or rake for further agitating a shag or sculptured carpet to improve the efficiency of soil removal. It will also be understood by those skilled in this art that the present invention of the suction nozzle means 44 and the jet stream means 46 could be employed with or without the rotating brush 48. The presence of the brush is preferred, but it may be eliminated and the suction nozzle means and the jet stream means will continue to cooperate with each other for improved efficiency over vacuum cleaning apparatus now on the market. Moreover, while the present invention has been shown as being employed in a hood or floor attachment or power nozzle of a canister-type vacuum cleaner, it will readily be apparent to those skilled in this art that this same invention could be incorporated into a vacuum hood of an upright vacuum cleaner without departing from the present invention. Moreover, this invention could employ a pulsating compressed air or other fluid medium instead of a constant flow.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. Vacuum cleaning apparatus having hood means supported on and movable along a surface to be cleaned and having its open side confronting the surface to form therewith a travelling vacuum chamber, said hood means comprising:

a. elongated brush means positioned transversely across the hood means and capable of rotational movement;

b. electric motor means mounted within the hood means and being provided with drive means joining the motor means to the brush means;

c. jet stream means also positioned transversely across the hood means adjacent the front side of the brush means, said jet stream means having a tubular header supporting a plurality of generally vertical flexible tubes, each tube having an orifice directed at a flat angle toward the working area of the brush means;

d. air compressor means mounted within the hood means, the said motor means having an extension shaft joined to the air compressor means for driving the same, and conduit means joined at one end to the output of the air compressor means and at its opposite end to the tubular header of the jet stream means;

e. suction nozzle means mounted within the hood means adjacent the backside of the brush means; and f. guide means adjacent the backside of the hood means for controlling the direction of travel of the hood means.

2. The invention as recited in claim 1 wherein the said combined motor means and air compressor means are mounted in the hood means above the suction nozzle means and adjacent the backside of the brush means.

3. The invention as recited in claims 1 or 2 wherein the said plurality of generally vertical flexible tubes are adapted to extend down close to the surface to be cleaned and their tips are capable of folding when they engage an obstruction, such as the strands of a high shag rug, so as not to get caught thereon.

4. Vacuum cleaning apparatus having hood means supported on and movable along a surface to be cleaned and having its open side confronting the surface to form therewith a travelling vacuum chamber, said hood means comprising:

a. electric motor means mounted within the hood means;

b. air compressor means mounted within the hood means, the said motor means having an extension shaft joined to the air compressor means for driving the same;

c. jet stream means positioned transversely across the hood means adjacent the front portion of the hood means, said jet stream means having a tubular header supporting a plurality of generally vertical flexible tubes, each tube having an orifice directed at a flat angle back toward the other end of the hood means;

d. suction nozzle means mounted within the hood means whereby the compressed air of the jet stream means is normally gathered up by the suction nozzle means and carried therefrom;

e. conduit means joined at one end to the output of the air compressor means and at its opposite end to the tubular header of the jet stream means.

5. The invention as recited in claim 4 wherein the said combined motor means and air compressor means are mounted in the hood means above the suction nozzle means.

6. The invention as recited in claims 4 or 5 wherein the said plurality of generally vertical flexible tubes are adapted to extend down close to the surface to be cleaned and they constitute a rake or comb which serves as a soil agitator for high shag rugs.

* * * * *